United States Patent [19]

Reynolds et al.

[11] 4,070,269

[45] Jan. 24, 1978

[54] UREA ADDUCTION PROCESS FOR REFRIGERATION OIL MANUFACTURE

[75] Inventors: Ronald W. Reynolds; John D. Tice, both of Wilmington, Del.; John S. Nutter, Glen Mills, Pa.

[73] Assignee: Suntech, Inc., Wayne, Pa.

[21] Appl. No.: 731,272

[22] Filed: Oct. 12, 1976

[51] Int. Cl.[2] ..... C10G 29/22; C10G 43/02

[52] U.S. Cl. ..... 208/25; 208/14

[58] Field of Search ..... 208/25

[56] References Cited

U.S. PATENT DOCUMENTS

| | | | |
|---|---|---|---|
| 2,731,455 | 1/1956 | Salzmann et al. | 208/25 |
| 2,786,015 | 3/1957 | Axe | 208/25 |
| 2,890,161 | 6/1959 | Brown et al. | 208/25 |
| 3,644,201 | 2/1972 | Paassen et al. | 208/25 |

*Primary Examiner*—Herbert Levine

*Attorney, Agent, or Firm*—J. Edward Hess; Donald R. Johnson; Paul Lipsitz

[57] ABSTRACT

In the process of manufacturing a refrigeration oil where an oil stock is dewaxed by forming a complex with urea in the presence of an activator, the improvement of adding hot vacuum gas oil to the separated urea complex whereby the activator is flashed off and is recycled for reuse and the slurry of the urea complex in the gas oil is treated with hot water to break the adduct and separate a water-urea mixture and oil and paraffin. The improved method enables accurate and uniform temperature control and degradation of urea is suppressed.

5 Claims, 1 Drawing Figure

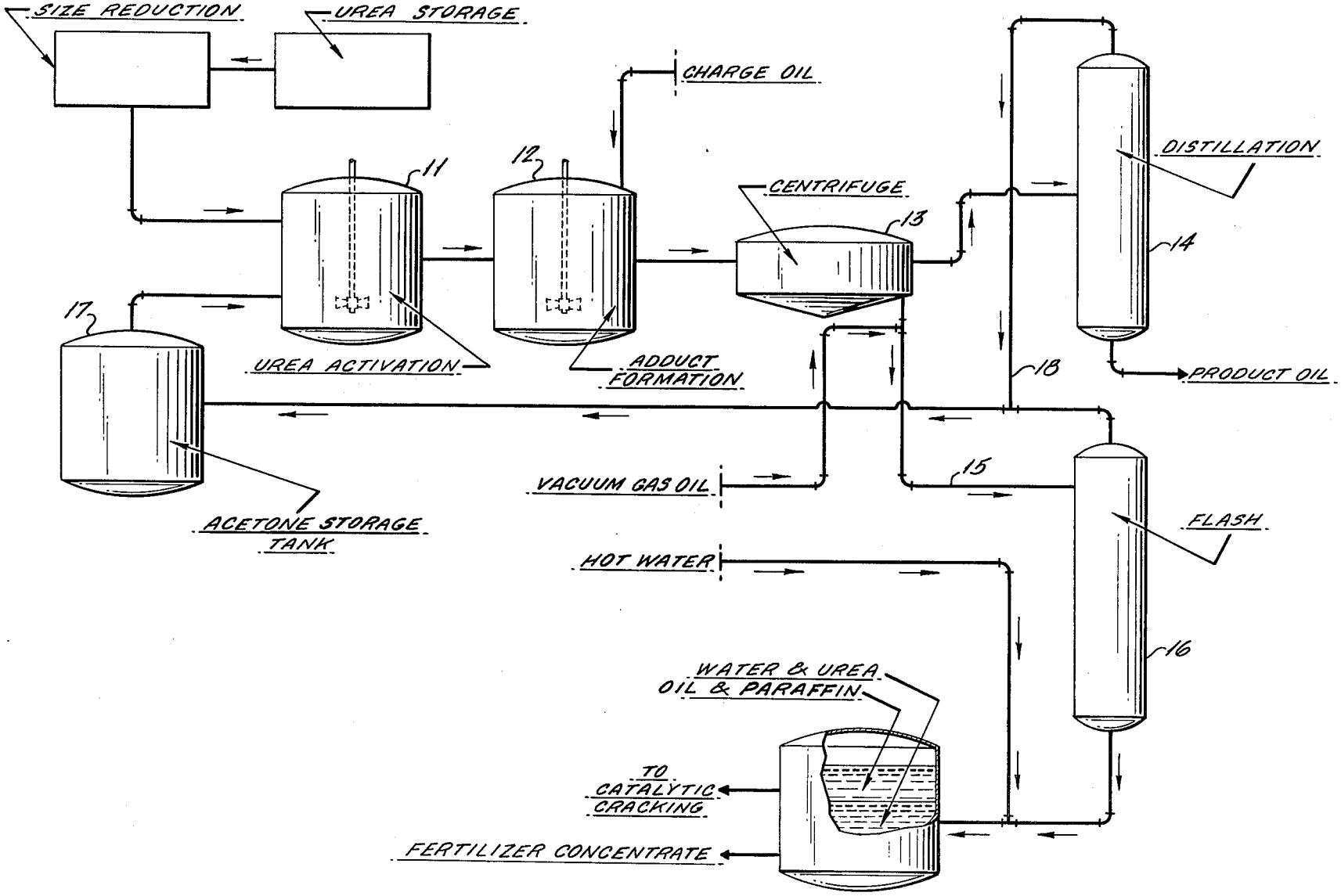
DISTILLATION
14
PRODUCT OIL
FLASH
16
18
15
13
CENTRIFUGE
CHARGE OIL
ADDUCT FORMATION
12
VACUUM GAS OIL
HOT WATER
WATER & UREA
OIL & PARAFFIN
TO CATALYTIC CRACKING
FERTILIZER CONCENTRATE
UREA STORAGE
11
UREA ACTIVATION
ACETONE STORAGE TANK
SIZE REDUCTION
17

UREA ADDUCTION PROCESS FOR REFRIGERATION OIL MANUFACTURE

It is known to remove paraffin compounds from lubricating oils by urea complexing to obtain refrigeration oils of low floc points. In U.S. Pat. No. 2,719,145, for example, such a process is described where the oil, urea and an activating agent, such as low molecular weight alcohols and ketones, are employed to prepare refrigeration oils which are characterized by a low Freon haze test. In the processes of the prior art, however, handling of the separated complex is often difficult leading to degradation of the urea to $CO_2$ and $NH_3$ and to the formation of biuret. This, of course, reduces the economic efficiency of urea recovery.

The present invention provides a particularly advantageous method for handling the solid urea complex which not only facilitates recovery of the activator, but also reduces urea decomposition. In addition, the uses for complex solid handling equipment is reduced by employing the process of the invention.

In accord with the invention, an oil stock is dewaxed by forming a complex with urea in the presence of an activator and after separating the urea-paraffin complex from the dewaxed oil, a hot vacuum gas oil is added to the complex to form a slurry, the activator is flashed off for reuse, the slurry treated with hot water to break the adduct, and oil and paraffin separated from water and urea.

The process of the invention is best illustrated by referring to the FIGURE. After urea from storage is reduced to the appropriate size (about 50 to about 75 mμ powder), it is fed to a urea activation reactor 11 together with the activator (acetone being preferred) and then the activated urea is taken to an adduct formation reactor 12. The refrigeration charge oil is introduced to reactor 12 where 5 to 15 pounds of urea per barrel of oil and 5 to 20% by volume of acetone are used. After adduct formation is carried out under agitation at atmospheric pressure and 70°–100° F with a 60 to 90 minute residence time, the mixture is then passed to a separator 13, a centrifuge being preferred. All of the steps thus far described are part of the prior art and are exemplified in more detail in U.S. Pat. No. 2,719,145, the disclosure of which is hereby incorporated by reference. The oil separated from the centrifuge or other separator is taken to a distillation column 14, the bottom product of which is the desired refrigeration oil which may be further treated, if desired, with acid and bauxite to obtain an oil of low floc point. The solid adduct from the centrifuge is slurried with hot vacuum gas oil which may be introduced at the centrifuge outlet at line 15 to make a pumpable slurry. One example of a suitable gas oil comes frm a naphthenic or grade A crude and has a 10% distillation point of approximately 480° F with a 90% point of 590° F. The gas oil will also have a viscosity of about 40 SUS at 100° F and API gravity around 27.0. Since the gas oil eventually goes to cracking, there is considerable leeway in the stream used. Any gas oil with at least a 450° F 10% distillation point and a vis below 200 SUS would be satisfactory. About 1 to 4 volumes of gas oil are added per volume of adduct, with about 2 volumes preferred. The temperature of the gas oil will be sufficient to vaporize the activator and with acetone as activator, the gas oil will be adjusted so as to have a temperature of about 200° F in the adduct gas oil slurry. The heat content of the gas oil is thus utilized to vaporize any acetone which remains in the adduct and this acetone vapor is removed in a flash drum 16. The acetone vapors are condensed (not shown) and together with condensed vapors from the distillation column 14 are recycled to storage tank 17 for reuse.

The gas oil-adduct leaving the flash drum is mixed with hot water at about 200° F to break the adduct. After settling, the gas oil/paraffin layer is sent to catalytic cracking and the water/urea layer may be sold as fertilizer concentrate. Alternatively, the water may be evaporated to give urea for reuse.

As indicated above, the process of this invention significantly improves material handling, making a slurry which is easily pumped. The gas oil contains sufficient heat to vaporize the activator which is recovered for reuse. By adding heat in this manner, accurate and uniform temperature control is obtained which minimizes degradation of urea to ammonia and carbon dioxide and the formation of biuret is suppressed.

The invention claimed is:

1. In the process of manufacturing a refrigeration oil where an oil stock is dewaxed by forming a complex with urea in the presence of an activator, the improvement of slurrying the separated urea complex with a vacuum gas oil at a temperature sufficient to vaporize said activator which is recycled for reuse, treating the activator-free urea complex with water in the presence of said gas oil to break said complex and separating a water-urea mixture and an oil and paraffin mixture.

2. In the process of manufacturing a refrigeration oil where an oil stock is dewaxed by forming a complex with urea in the presence of an activator, the improvement of slurrying the separated urea complex with 1 to 4 volumes per volume of complex of a vacuum gas oil having at least a 450° F 10% distillation point at a temperature sufficient to vaporize said activator which is recycled for reuse, treating the activator-free urea complex with water in the presence of said gas oil to break said complex and separating a water-urea mixture and an oil and paraffin mixture.

3. The process of claim 2 where the activator is acetone.

4. The process of claim 3 where the slurry of gas oil and urea complex is at a temperature of about 200° F.

5. The process of claim 4 where each volume of separated urea complex is slurried with about 2 volumes of gas oil.

* * * * *